United States Patent [19]

Verdin

[11] Patent Number: 4,779,705

[45] Date of Patent: Oct. 25, 1988

[54] HEADER EXHAUST ADAPTER

[76] Inventor: Roy P. Verdin, P.O. Box 179, Dulac, La. 70353

[21] Appl. No.: 925,677

[22] Filed: Oct. 31, 1986

[51] Int. Cl.[4] ..... F01N 7/08

[52] U.S. Cl. ..... 181/236; 181/240; 181/253

[58] Field of Search ..... 181/236, 240, 227, 253, 181/254, 228

[56] References Cited

U.S. PATENT DOCUMENTS

| | | | |
|---|---|---|---|
| 1,179,075 | 4/1916 | Collins | 181/236 |
| 1,227,461 | 5/1917 | Losee | 181/236 |
| 1,447,380 | 3/1923 | Goetz | 181/236 |
| 1,615,147 | 1/1927 | Taylor | 181/254 |
| 1,615,564 | 1/1927 | Beery | 181/236 |
| 1,626,908 | 5/1927 | Armstrong | 181/236 |
| 1,766,973 | 6/1930 | Beck | 181/236 |
| 1,840,082 | 1/1932 | Breer | 181/236 X |
| 2,968,359 | 1/1961 | Cocker | 181/236 |
| 3,749,199 | 7/1973 | Weber | 181/236 |

*Primary Examiner*—Benjamin R. Fuller

*Attorney, Agent, or Firm*—Pravel, Gambrell, Hewitt, Kimball & Krieger

[57] ABSTRACT

The apparatus would include a body portion positionable intermediate the exhaust manifold and the muffler or the catalytic converters if the car is adapted with such, so that exhaust gases, under a first condition, can flow through the body portion and into the muffler prior to exiting to atmosphere, and under a second condition, via the removal of a plate member, a greater portion of the exhaust gases would be exhausted directly out to atmosphere bypassing the remainder of the exhaust system including the muffler and/or catalytic converter.

5 Claims, 1 Drawing Sheet

HEADER EXHAUST ADAPTER

BACKGROUND OF THE INVENTION

1. Field of the Invention

The apparatus of the present invention relates to vehicle exhaust systems. More particularly, the present invention relates to an adapter for vehicle exhaust systems which would be placed intermediate the manifold from the exhaust on the internal combustion engine and the muffler for selectively allowing the exhaust to bypass the muffler for direct exhaust from the header to the atmosphere.

2. General Background

In the area of exhaust systems for vehicles, particularly automobiles, the exhaust system is provided with a silencing mechanism or muffler which helsp to limit the noise from the development of the exhaust gases to a legally permissible decibal level. However, due to the passage of the exhaust through the muffler system, the output of the internal combustion engine is reduced. Therefore, it is sometimes necessary, for example for racing or the like that the output of the internal combustion engine be increased so that the full output can be explored.

In the present state of the art, this is usually undertaken by a removal of the muffler from the exhaust system, or by interchanging of the muffler system to a different system as to have direct exhaust from the header into atmosphere for the necessary output of the engine desired. There could be a considerable expenditure in addition to the continuing task of installation and disassembling of the exhaust gas mufflers in order to interchange between the use of the muffler and the use of the header without the muffler. Therefore, it would be advantageous to have a system incorporated into an existing muffler system on an automobile or the like, whereby a simple maneuvering of a few parts would allow the exhaust from the engine to bypass the muffler and be directed to ambient atmosphere through the header. Likewise, it would be advantageous to, by simple replacement of several parts re-set the use of the muffler system in normal use of the vehicle.

Several patents have been granted which address the question of automobile exhaust systems, the most pertinent being as follows:

U.S. Pat. No. 3,749,199 issued to Weber, entitled "Exhaust Gas Muffler For Internal Combustion Engines Of Vehicles", relates to an apparatus that provides an exhaust gas muffler which can be adapted to utilization between a muffler and without a muffler. The exhaust gas muffler is constructed as a combination muffler with several exhaust pipes in which exhaust gas conduction from the internal combustion engine to the exhaust pipe takes place selectively by way of silencing means of the muffler or in bypassing the silencing means into the atmosphere.

U.S. Pat. No. 1,179,075 issued to Collins, entitled "Cut-Out Silencer", relates to a device for cutting out the mufflers and to permit the exhaust to pass directly into the atmosphere having a perforated member at or over the outer or discharge terminal of a cut out tube or pipe which opens from the exhaust tube or pipe to a point between the engine and muffler.

U.S. Pat. No. 1,227,461 issued to J. S. Losee, entitled "Muffler Cut-Out", relates to a hollow member forming a head therefore in open communication intermediate the muffler casing at the ends of the hollow member being opened and in line with each other for connection with the exhaust pipe of an engine in the opposite end open to the atomsphere. There is also included a valve for closing the second end of the pipe.

U.S. Pat. No. 1,447,380 issued to Goetz, entitled "Combined Muffler And Cut-Out", relates to an exhaust cut-out positioned within a muffler proper having a common valve member for closing the cut-out and for opening the cut-out and shutting off the muffler to direct the exhaust gases directly into the atmosphere.

U.S. Pat. No. 2,968,359 issued to J. Cocker, entitled "Muffler Construction", relates to an apparatus for deflecting the exhaust gases from going through the muffler to bypassing the muffler and going straight to the exhaust pipe without the use of internal valving members or the like.

U.S. Pat. No. 1,615,564, issued to Beery, U.S. Pat. No. 1,626,908, issued to Armstrong, U.S. Pat. No. 1,840,082, issued to Breer, and U.S. Pat. No. 1,766,973, issued to Beck all teach various types of silencer mufflers for internal combustion engines.

SUMMARY OF THE PRESENT INVENTION

The apparatus of the present invention seeks to provide an apparatus for directing exhaust gases from the header of the exhaust system directly to atmosphere by bypassing the muffler. The apparatus would include a body portion positionable intermediate the exhaust manifold and the muffler or the catalytic converters (if the car is adapted with such), so that exhaust gases, under a first condition, can flow through the body portion and into the muffler prior to exiting to atmosphere, and under a second condition, via the removal of a plate member, that a greater portion of the exhaust would be exhausted directly out to atmosphere bypassing the remainder of the exhaust system including the muffler and/or catalytic converter.

Therefore, it is a principal object of the present invention to provide a system that can be easily installed in an existing muffler system and more easily adaptable to providing direct exhaust into atmosphere in a second condition and exhaust through the muffler system in a first condition;

It is a further object of the present invention to provide an exhaust system adapter which through the removal of a single plate allows exhast of gases from the engine directly into atmosphere bypassing the muffler system;

Another object of the present invention is to provide an exhaust system adapter which upon the replacement of an end plate would allow exhaust gases to be routed through the muffler system prior to being exhausted to atmosphere.

DETAILED DESCRIPTION OF THE DRAWINGS

Figures 1, 2:
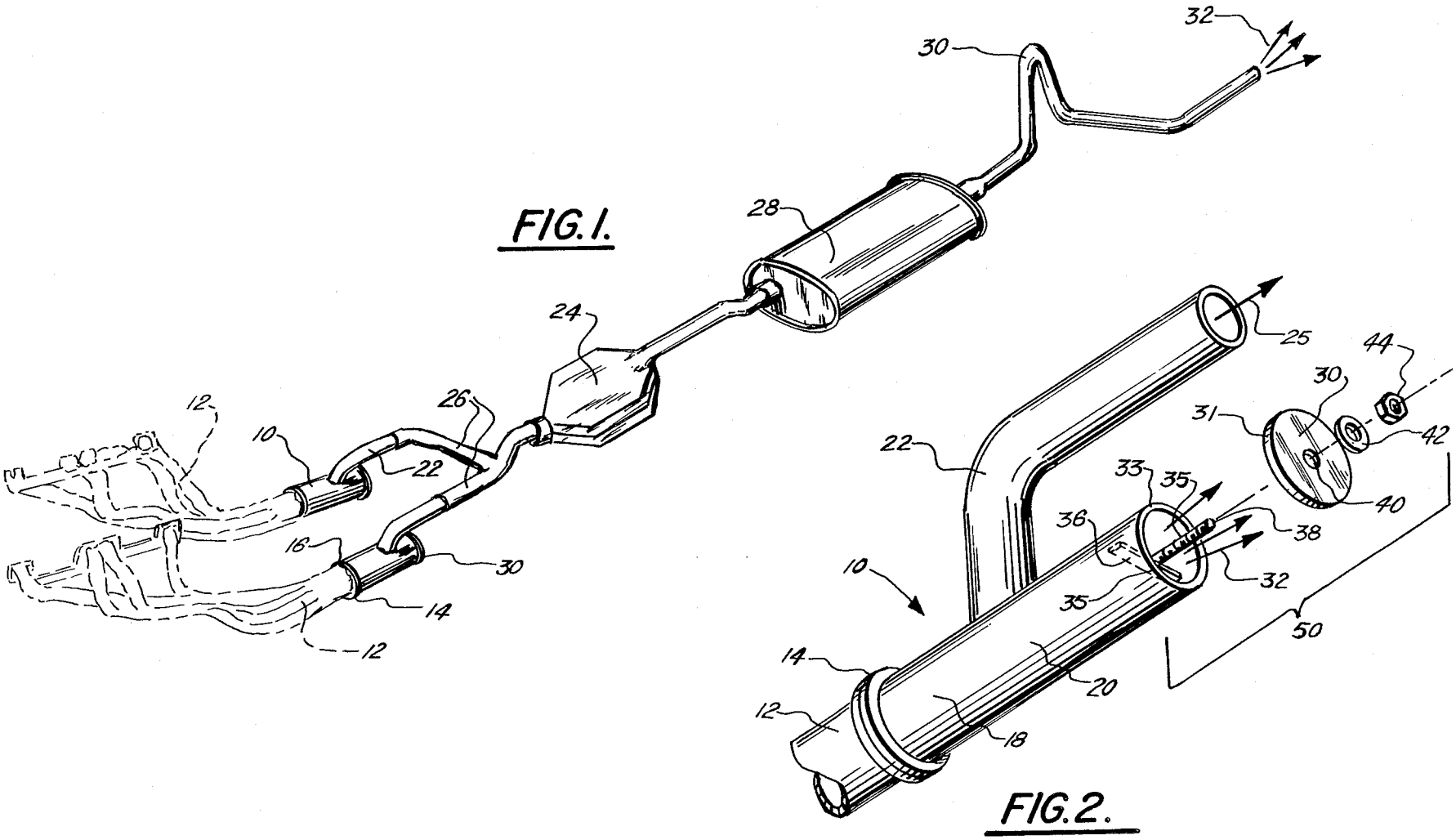

FIG. 1 is an overall view of the adapter of the present invention installed within an existing muffler system; and FIG. 2 is a isometric view of the exhaust adapter of the present invention illustrating the adapter in a condition with the end plate removed therefrom.

DETAILED DESCRIPTION OF THE PREFERRED EMBODIMENT

The apparatus of the present invention is illustrated in FIGS. 1 and 2 by the numeral 10. Turning to FIG. 1, there is illustrated an internal combustion engine vehicle muffler system which illustrates the component parts of an engine exhaust manifold 12 connected to present apparatus 10 via a connecting joint 14, which would generally comprise a flared face between the manifold 12 and the apparatus 10 having a gasket 16 or the like therebetween with the faces bolted together to form an airtight joint so that gases traveling through manifold 12 will travel into the forward body portion 18 of apparatus 10 then into main body portion 20 of the apparatus. In view of the fact that apparatus 10 is in the first position to provide that gases flow through the remainder of the muffler system, the exhaust gases would then flow into rearward upper body portion 22 of the apparatus which is connectably engaged to catalytic converter 24 in the same manner as with joint 14 as was discussed earlier. The exhaust gases would then flow out of the catalytic converter 24 to exhaust line 26 and into muffler 28 and into exhaust pipe 30 and be expelled to atmosphere as seen by Arrows 32. Therefore, as seen in FIG. 1, apparatus 10, the structure of which will be discussed more fully in FIG. 2, is functioning in this first position as simply a continuation of the flow path of the exhaust gases through a normal exhaust muffler system.

In the event one would wish to bypass the muffler system at the point of the position of the apparatus, as seen in FIG. 2, apparatus 10 is shown again connectably engaged to exhaust manifold 12 to form an airtight seal at joint 14 to the forward body portion 18 of apparatus 10. It will be recalled that, as was discussed in the description of FIG. 1, under normal circumstances the gases flowing through the forward body portion 18 would normally flow into main body 20 and up through rearward upper body portion 22 to the catalytic converter 24, although not seen in FIG. 2, flowing in the direction of Arrow 25. However, as seen in FIG. 2, the rear face portion 28 of body portion 20 is adapted with a sealing end plate 30 which is substantially of the same or slightly greater circumference than the body portion 20 and the inner surface 31 of plate 30 sealably engages the rearwardmost end portion 33 of body portion 20 to effect a fluid-tight seal as seen in FIG. 1 when in that position. Plate 30 would be held in position via a mounting bolt 35 which is mounted into the interior flow bore of body portion 20 via a cross mounting plate 36 rigidly attached to the end 37 of bolt 35 so that the threaded portion 38 of bolt 35 extrudes further than end 33 of body portion 20. Therefore, plate 30 is adapted with a centrally located orifice 40 which is of sufficient circumference to accommodate the passage of threaded portion 38 of bolt 35 therethrough and upon bolt 35 being placed through orifice 40, washer 42 is placed in position and nut 44 is secured onto threaded portion 38 with sufficient torque so as to effect a seal between the inner surface 31 of end plate 30 and end portion 33 of body portion 20 so that any exhaust gas going into body 20 will be required to exhaust through upper body portion 22 when end plate 30 is in secured position as seen in FIG. 1.

Therefore, in operation, it is quite easy to understand that after apparatus 10 has been installed into position as seen in FIG. 1, that is intermediate the muffler system and the exhaust manifold 12, and the end plate 30 has been secured into sealing position as seen in FIG. 1, then the apparatus 10 serves as simply a conduit between the exhaust manifold 12 and the muffler system to direct exhaust gases up through the upper body portion 22 into the remainder of the muffler system and out of the exhaust pipe 30. However, following the removal of plate 30 as seen in FIG. 2, plate 30 then serves as a means of allowing the exhaust gases to substantially bypass upper body portion 22 and the muffler system and exhaust directly out of main body portion 20 in the direction of Arrows 52 into atmosphere, thus allowing the engine to perform more fully and efficiently and to serve as direct "headers" from the engine to the exhaust system.

Because many varing and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as invention is:

1. An apparatus for functioning as a header in an exhaust system of a vehicle, the apparatus positionable between an exhaust manifold and an exhaust muffler system, the apparatus comprising a body having a forward body portion connectable to the exhaust manifold, a rearward body portion having opposing ends wherein at least one of said ends is connectable to the exhaust muffler system, and a main body portion having extruded therefrom the rearward body portion at the other of said ends, and comprising an exhaust gas flow area with the rearward body portion, the main body portion further having an end plate threadably engaged onto an end of the main body portion so that in a first secured position the end plate directs flow of exhaust gases into the exhaust muffler system, and in the second unsecured position allows flow directly out of the main body portion so that the main body portion functions as a header for expelling gases to atmosphere bypassing the muffler system.

2. A vehicle exhaust adapter apparatus, comprising:

a. a main body portion;

b. a forward body portion connectable to an exhaust manifold;

c. a rearward body portion extruded at one end thereof from the main body portion and connectable at another end thereof to a vehicle exhaust muffler system wherein the main body portion comprises an exhaust gas flow area with the rearward body portion; and d. directing means positionable on the main body portion for selectively allowing exhaust gases traveling through the adapter to flow through the exhaust muffler system when the directing means is in a first, secured position and to substantially bypass the exhaust muffler system and to exhaust directly into atmosphere when the directing means is in a second, unsecured position, wherein the directing means comprises an end plate positionable upon the rearwardmost end portion of the main body portion, the end plate threadably engaged to the rearwardmost end portion of the main body portion for enabling exhaust gases to flow through the exhaust muffler system, and when unsecured from the body portion allowing exhaust gases to flow through the main body portion and bypass the exhaust muffler system.

3. The apparatus in claim 2, wherein the apparatus functions as a direct exhaust header through which the engine exhaust gases are expelled to atmosphere.

4. The apparatus in claim 2, wherein the apparatus is easily positionable between the exhaust manifold and the exhaust muffler system and does not require being removed when not in use.

5. The apparatus in claim 8, wherein the forward body portion comprises a pipe of substantially the same circumference as the exhaust manifold and is secured directly thereto.

* * * * *